US009375931B2

(12) United States Patent
Kobashi

(10) Patent No.: US 9,375,931 B2
(45) Date of Patent: Jun. 28, 2016

(54) LIQUID RECEIVING APPARATUS, LIQUID EJECTING APPARATUS, AND METHOD OF DISCHARGING LIQUID

(71) Applicant: SEIKO EPSON CORPORATION, Tokyo (JP)

(72) Inventor: Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/612,928

(22) Filed: Feb. 3, 2015

(65) Prior Publication Data

US 2015/0246535 A1 Sep. 3, 2015

(30) Foreign Application Priority Data

Feb. 28, 2014 (JP) ..... 2014-038187

(51) Int. Cl.
*B41J 2/14* (2006.01)
*B41J 2/165* (2006.01)

(52) U.S. Cl.
CPC ..... *B41J 2/16508* (2013.01); *B41J 2/16511* (2013.01); *B41J 2/16523* (2013.01)

(58) Field of Classification Search
CPC .... B41J 2/155; B41J 2/16505; B41J 2/16508; B41J 2/16511; B41J 2/16585
USPC ..... 347/29–33, 36, 44
See application file for complete search history.

(56) References Cited

U.S. PATENT DOCUMENTS

| | | | | |
|---|---|---|---|---|
| 2005/0046666 | A1 | 3/2005 | Horio | |
| 2006/0290738 | A1* | 12/2006 | Kusunoki et al. | 347/29 |
| 2011/0122188 | A1* | 5/2011 | Mitsunaga | 347/16 |
| 2011/0279525 | A1* | 11/2011 | Suzuki et al. | 347/30 |

FOREIGN PATENT DOCUMENTS

| | | |
|---|---|---|
| JP | 2005-074767 | 3/2005 |
| JP | 2006-007678 | 1/2006 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid receiving apparatus includes a liquid holder including a discharging hole for discharging liquid, a bottom portion in which the discharging hole is disposed, and a wall rising from the bottom portion and surrounding the discharging hole. The bottom portion and the wall define a liquid retaining section configured to retain the liquid. The liquid holder is configured to move in a first movement direction intersecting a gravity direction. The wall includes a first inclined wall oblique to the first movement direction. The discharging hole is positioned next to the first inclined wall.

9 Claims, 4 Drawing Sheets

LIQUID RECEIVING APPARATUS, LIQUID EJECTING APPARATUS, AND METHOD OF DISCHARGING LIQUID

BACKGROUND

1. Technical Field

The present invention relates to a liquid receiving apparatus configured to receive liquid such as ink, a liquid ejecting apparatus, and a method of discharging liquid.

2. Related Art

An example of a liquid ejecting apparatus is an ink jet printer configured to release ink from a nozzle of a recording head for printing. Such a printer may include a cap having a recess to receive the ink released from the nozzle. The recess may have an inner surface inclined toward an outlet included in a bottom of the recess such that the ink is promptly discharged through the outlet (see JP-A-2006-7678).

The inclined inner surface of the recess may reduce cap capacity, which results in reduction in the amount of the liquid to be held in the cap.

Such a problem is not limited to the cap used for capping. The problem is common to a liquid receiving apparatus and a liquid ejecting apparatus each including a liquid holder, which is configured to temporarily hold the liquid, such as a flushing box configured to receive the liquid released from the nozzle during a flushing operation.

SUMMARY

An advantage of some aspects of the invention is that a liquid receiving apparatus, a liquid ejecting apparatus, and a method of discharging liquid, which have an improved ability to discharge the liquid without reducing the amount of liquid to be received, can be provided.

Hereinafter, means for solving the above problem and advantages obtained by the means will be described.

According to a first aspect of the invention, a liquid receiving apparatus includes a liquid holder including a discharging hole for discharging liquid, a bottom portion in which the discharging hole is disposed, and a wall that extends from the bottom portion and surrounds the discharging hole. The bottom portion and the wall define a liquid retaining section configured to retain the liquid. The liquid holder is configured to move in a movement direction intersecting the gravity direction. The wall includes an inclined wall oblique to the movement direction. The discharging hole is positioned next to the inclined wall.

In this configuration, when the liquid holder is moved in the movement direction, the liquid in the liquid retaining section flows in a direction opposite to the movement direction on the bottom portion due to the inertial force and flows along the inclined wall, which oblique to the movement direction. Then, the liquid flowing along the inclined wall flows to the discharging hole positioned next to the inclined wall, and thus the liquid is promptly discharged through the discharging hole. Accordingly, the liquid receiving apparatus has an improved ability to discharge the liquid without having an inclined bottom portion, which reduces the amount of liquid to be received.

It is preferable that the discharging hole be positioned closer to an edge of the inclined wall on a start position side of the movement direction than to another edge of the inclined wall on an end position side of the movement direction.

With this configuration, the liquid flowing in the opposite direction along the inclined wall can be gathered from the end position side of the movement direction to the start position side and efficiently discharged through the discharging hole, since the discharging hole is positioned closer to the edge of the inclined wall on the start position side of the movement direction than to the other edge on the end position side of the movement direction.

It is preferable that the bottom portion include a first bottom surface defining the liquid retaining section and a second bottom surface opposite the first bottom surface. The discharging hole may have a funnel-like shape having a tapered surface in which an opening area on the second bottom surface of the bottom portion is smaller than an opening area on the first bottom surface. The discharging hole may be positioned such that a part of the tapered surface meets the inclined wall. The tapered surface may form a larger inclined angle with the first bottom surface at the part meeting the inclined wall than at another part thereof not meeting the inclined wall.

With this configuration, the liquid that comes in contact with the inclined wall is allowed to flow along the part of the tapered surface that forms the larger inclined angle, and the liquid is promptly discharged through the discharging hole, since the tapered surface of the discharging hole forms a large inclined angle with the first bottom surface at the meeting point where the tapered surface meets the inclined wall. Additionally, the liquid flowing along the first bottom surface toward the discharging hole is allowed to flow gently along the part of the tapered surface that forms a smaller inclined angle, and the liquid is promptly discharged through the discharging hole without having disturbed liquid flow.

It is preferable that the wall include two inclined walls facing each other and two side walls. The inclined walls and the side walls meet each other.

With this configuration, the liquid can flow along the inclined walls when the liquid holder is reciprocated in the movement direction, since the wall includes two inclined walls facing each other. Specifically, the liquid can flow along one of the inclined walls during an outward movement of the liquid holder, and the liquid can flow along the other one of the inclined walls during a return movement of the liquid holder. Furthermore, since the inclined walls meet the side walls, the liquid can flow along the inclined walls and the side walls. This reduces turbulence in the flow in the liquid retaining section.

It is preferable that the inclined wall curve with respect to the movement direction.

This configuration reduces turbulence in the flow and allows the liquid to flow along the inclined wall when the liquid flowing in the direction opposite to the movement direction comes in contact with the inclined wall, since the inclined wall curves with respect to the movement direction.

It is preferable that the liquid receiving apparatus include an air releasing mechanism connected to the liquid holder. The liquid retaining section of the liquid holder may be configured as a closed area when the wall of the liquid holder is in contact with an object. The bottom portion of the liquid holder may include a communication hole communicating with the air releasing mechanism. The communication hole may be positioned closer than the discharging hole to the edge of the bottom portion on the end position side of the movement direction.

With this configuration, most of the liquid flowing along with the movement of the liquid holder does not enter the communication hole, since the communication hole is positioned closer than the discharging hole to the edge of the bottom portion on the end position side of the movement direction.

It is preferable that the communication hole open at a position above the bottom portion in the vertical direction.

With this configuration, most of the liquid in the liquid retaining section does not enter the communication hole, since the communication hole opens at the position above the bottom portion in the vertical direction.

According to a second aspect of the invention, a liquid ejecting apparatus may be provided that includes the above liquid receiving apparatus and a liquid ejector configured to eject liquid.

This liquid ejecting apparatus can provide the same advantages as the above liquid receiving apparatus.

According to a third aspect of the invention, a method of discharging liquid may be provided. In the method of discharging liquid from a liquid retaining section of a liquid holder through a discharging hole, the liquid holder includes the discharging hole for discharging liquid, a bottom portion at which the discharging hole is disposed, and a wall that extends from the bottom portion and surrounds the discharging hole. The liquid retaining section is defined by the bottom portion and the wall. The method includes moving the liquid holder in a movement direction intersecting a gravity direction such that the liquid in the liquid retaining section flows in a direction opposite to the movement direction, allowing the liquid flowing in the direction opposite to the movement direction to flow along an inclined wall oblique to the movement direction, and passing the liquid flowing along the inclined wall through the discharging hole positioned next to the inclined wall to discharge the liquid. The inclined wall is included in the wall.

This can provide the same advantages as the above liquid receiving apparatus.

It is preferable that the above method of discharging liquid further include applying suction to the liquid retaining section through the discharging hole.

With this configuration, the liquid in the liquid retaining section can be promptly discharged from the liquid retaining section, since the flow of the liquid into the discharging hole is accelerated by applying suction to the liquid retaining section through the discharging hole.

BRIEF DESCRIPTION OF THE DRAWINGS

The invention will be described with reference to the accompanying drawings, wherein like numbers reference like elements.

DESCRIPTION OF EXEMPLARY EMBODIMENT

An embodiment of a liquid ejecting apparatus will be described with reference to the drawings. The liquid ejecting apparatus is, for example, an ink jet printer configured to eject ink, which is an example of liquid, onto a medium such as a sheet of paper, for recording (printing).

Figure 1:
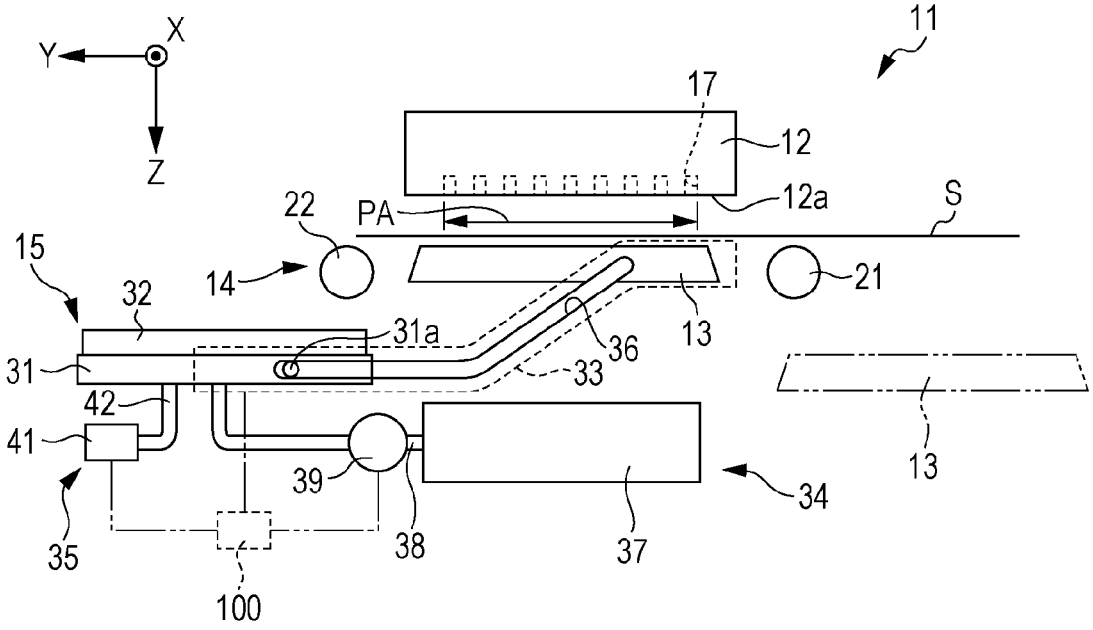
FIG. 1 is a side view illustrating a configuration of a liquid ejecting apparatus in an embodiment of the invention.

As illustrated in FIG. 1, a liquid ejecting apparatus 11 includes a liquid ejector 12 configured to eject liquid, a supporting table 13 for supporting a medium S, a transport mechanism 14 for transporting the medium S in a transporting direction Y, and a liquid receiving apparatus 15 for receiving the liquid ejected by the liquid ejector 12. The transporting mechanism 14 includes transport rollers 21, 22 positioned upstream and downstream of a printing area PA in the transporting direction Y, for example. The transporting mechanism 14 may include a transporting belt on which the medium S is placed.

The liquid ejector 12 includes a plurality of nozzles 17 configured to eject liquid in the form of droplets. In the printing area PA, the liquid ejector 12 ejects the liquid droplets through the nozzles 17 onto the medium S, which is transported by the transporting mechanism 14, to perform printing.

The supporting table 13 moves between a supporting position (indicated by a solid line in FIG. 1), which is set inside of the printing area PA, and a retracted position (indicated by a two-dotted chain line in FIG. 1), which is set outside of the supporting area PA. For example, the supporting table 13 moves to the supporting position and supports the medium S to receive the droplets when the medium S is transported to the printing area PA. After printing, the supporting table 13 moves to the retracted position.

The liquid receiving apparatus 15 includes a liquid holder 32 supported by a support 31, a movement mechanism 33 configured to move the liquid holder 32 via the support 31 in a movement direction intersecting the gravity direction, a discharging mechanism 34 connected to the liquid holder 32, and an air releasing mechanism 35 connected to the liquid holder 32. The liquid ejecting apparatus 11 includes a controller 100 configured to control the movement mechanism 33, the discharging mechanism 34, and the air releasing mechanism 35.

Figure 2:
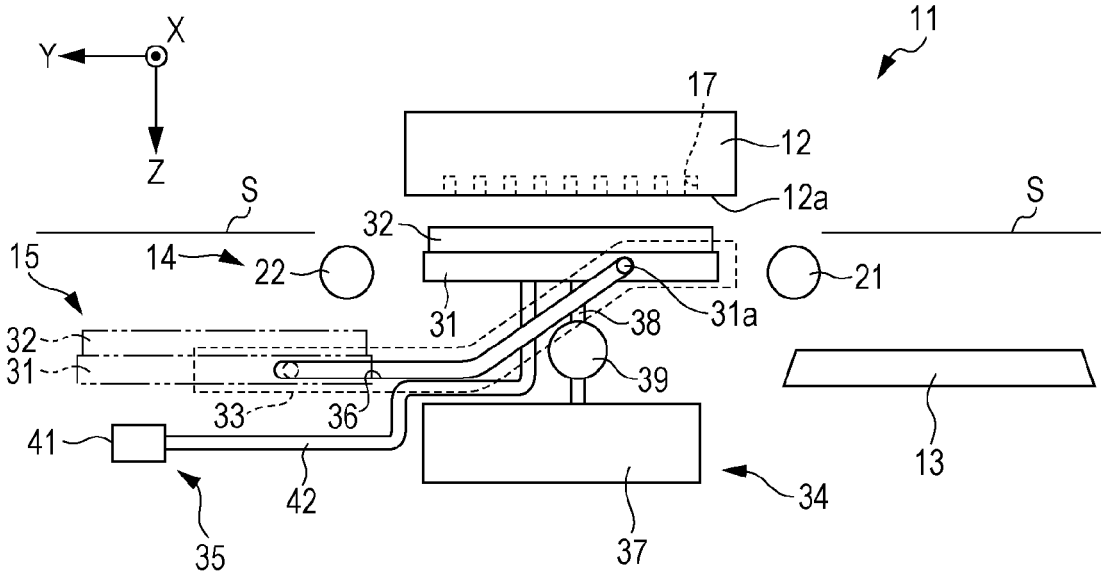
FIG. 2 is a side view illustrating an operation of a liquid receiving apparatus in an embodiment of the invention.

As illustrated in FIG. 2, the movement mechanism 33 includes a guide rail 36 for guiding a projection 31*a* of the support 31. The movement mechanism 33 moves the liquid holder 32 between a receiving position (indicated by a solid line in FIG. 2), which is set inside the printing area PA, and a standby position (indicated by a two-dotted chain line in FIG. 2), which is set outside of the printing area PA. The standby position of the liquid holder 32 is away from the receiving position in both the gravity direction (vertical direction) Z and the transporting direction Y.

The discharging mechanism 34 includes a collection portion 37 configured to store the liquid, a discharging passage 38 connecting the collection portion 37 and the liquid holder 32, and a reduced-pressure portion 39 positioned in the middle of the discharging passage 38. The air releasing mechanism 35 includes an air releasing valve 41 and a ventilation passage 42 connecting the air releasing valve 41 and the liquid holder 32. The discharging passage 38 and the ventilation passage 42, which are made of flexible tubes for example, move according to the movement of the liquid holder 32.

Figure 3:
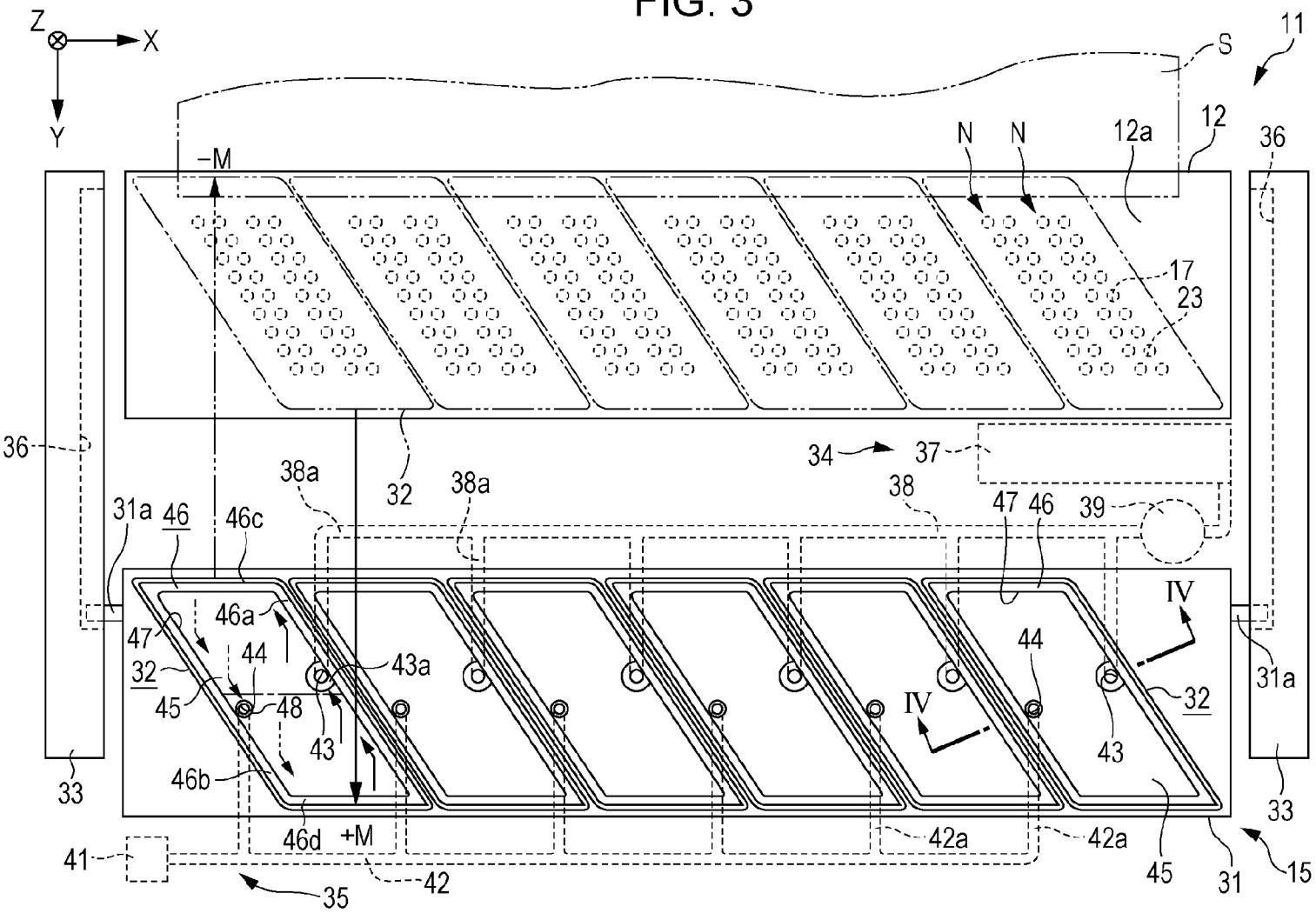
FIG. 3 is a top view illustrating a configuration of a liquid ejector and a liquid receiving apparatus.

As illustrated in FIG. 3, a longitudinal direction of the liquid ejector 12 in this embodiment corresponds to a width direction X of the medium S, which intersects the transporting direction Y. In an open surface 12*a* of the liquid ejector 12, a lower end of each nozzle 17, which is an ejection hole 23 for liquid droplets, is positioned.

The nozzles 17 are arranged in a direction oblique to the transporting direction Y and the width direction X to form a nozzle line N. The liquid ejector 12 includes a plurality of nozzle lines N that are arranged in the width direction X with predetermined intervals therebetween. The number of nozzles 17 and the number of nozzle lines N included in the liquid ejector 12 may be any value.

Two of a projection 31*a* of the support 31 are provided as a pair at an upstream position in the transporting direction Y so as to protrude from each end of the support 31 in the width direction X. The projections 31*a* are connected to the guide rails 36 positioned close to the respective end in the width direction X of the support 31. The projections 31*a* of the support 31 are guided by the guide rails 36 during the movement of the liquid holder 32 between the receiving position and the standby position.

In this embodiment, a movement direction of the liquid holder 32 from the receiving position, which is indicated by the two-dotted chain line in FIG. 3, to the standby position, which is indicated by the solid line in FIG. 3, is referred to as a first movement direction +M, and a movement direction of the liquid holder 32 from the standby position to the receiving position is referred to as a second movement direction −M. In the first movement direction +M, the receiving position and the standby position correspond to a start position and an end position, respectively, of the movement. In the second movement direction −M, the standby position and the receiving position correspond to a start position and an end position, respectively, of the movement. The first movement direction +M and the second movement direction −M intersect the gravity direction.

On the support 31, multiple liquid holders 32 (six liquid holders 32 in this embodiment) are arranged in the width direction X. The liquid holder 32 of this embodiment includes a discharging hole 43 communicating with the discharging passage 38, a communication hole 44 communicating with the ventilation passage 42, a bottom portion 45 where the discharging hole 43 and the communication hole 44 are disposed, and a wall 46 that extends from the bottom portion 45 and surrounds the discharging hole 43 and the communication hole 44. The liquid holder 32 is a cap having a box-like shape with a bottom. The bottom portion 45 and the wall 46 of the liquid holder 32 define a liquid retaining section 47 configured to retain the liquid. An opening of the cap defined by the wall 46 is large enough to encompass the multiple nozzle lines N (for example, four nozzle lines). The number of liquid holders 32 included in the liquid receiving apparatus 15 may be suitably changed. For example, the liquid receiving apparatus 15 may include only one liquid holder 32 large enough to surround all the ejection holes 23.

In the liquid receiving apparatus 15 including multiple liquid holders 32, the discharging passage 38 and the ventilation passage 42 each branch into branched passages 38*a*, 42*a* at one end connected to the bottom portion 45 of the liquid holder 32. The discharging passage 38 and the ventilation passage 42 do not branch at the other end and are connected to the collection portion 37 and the air releasing valve 41, respectively.

The wall 46 includes two inclined walls 46*a*, 46*b* that are parallel to each other and face each other and two side walls 46*c*, 46*d* that are parallel to each other and face each other. The inclined walls 46*a*, 46*b* and the side walls 46*c*, 46*d* meet each other. The inclined walls 46*a*, 46*b* extend oblique to the movement directions +M, −M. The inclined walls 46*a*, 46*b* both preferably have an inclined angle equal to the inclined angle of the nozzle line N with respect to the transporting direction Y and the width direction X. In this embodiment, the inclined wall 46*a*, which is on the right side in FIG. 3, is referred to as a first inclined wall 46*a*, and the inclined wall 46*b*, which is on the left side in FIG. 3, is referred to as a second inclined wall 46*b*. In this embodiment, the side walls 46*c*, 46*d* extend in a direction perpendicular to the movement directions +M, −M.

The discharging hole 43 in the bottom portion 45 of the liquid holder 32 is positioned next to the first inclined wall 46*a*. In the liquid holder 32, the position of the discharging hole 43 is preferably closer to an edge of the first inclined wall 46*a* on the start position side of the first movement direction +M than to the other edge on the end position side of the first movement direction +M.

In the liquid holder 32, the communication hole 44 is preferably positioned closer to an edge of the second inclined wall 46*b* on the end position side of the first movement direction +M than to the other edge on the start position side of the first movement direction +M. In addition, the communication hole 44 is preferably positioned closer than the discharging hole 43 to the edge on the end position side of the first movement direction +M. As illustrated in the leftmost liquid holder 32 in FIG. 3, a single-dotted chain line indicates the middle position of the inclined walls 46*a*, 46*b* in the first movement direction +M. The discharging hole 43 is positioned on the receiving position side (on the rearward side in the first movement direction +M) in relation to the single-dotted chain line. The communication hole 44 is positioned on the standby position side (on the forward side in the first movement direction +M) in relation to the single-dotted chain line.

Figure 4:
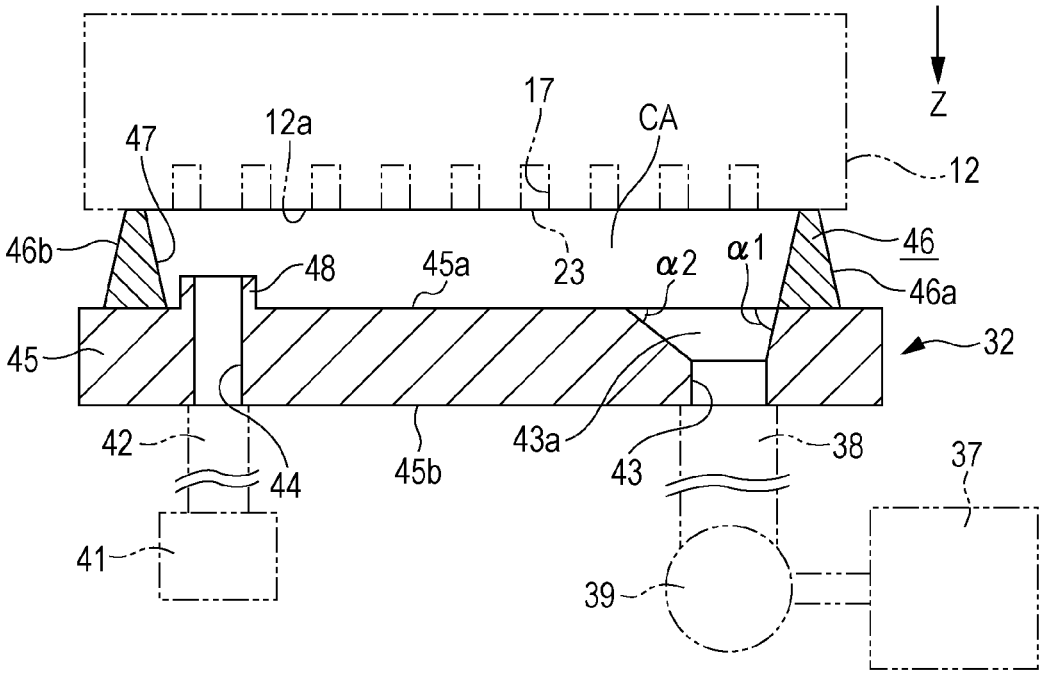
FIG. 4 is a cross-sectional view taken along line IV-IV in FIG. 3.

As illustrated in FIG. 4, the bottom portion 45 of the liquid holder 32 has a first bottom surface 45*a*, which defines a liquid retaining section 47, and a second bottom surface 45*b*, which is opposite the first bottom surface 45*a*. In the liquid holder 32, the discharging hole 43 has a tapered surface 43*a*, which forms a funnel shape, such that the discharging hole 43 has a smaller opening area on the second bottom surface 45*b* of the bottom portion 45 than that on the first bottom surface 45*a*. The tapered surface 43*a* is preferably positioned such that a part thereof meets the first inclined wall 46*a*. The tapered surface 43*a* preferably has one end (an upper end in this embodiment) that meets the first bottom surface 45*a*. However, the other end (a lower end in this embodiment) of the tapered surface 43*a* may not meet the second bottom surface 45*b*.

The tapered surface 43*a* of the discharging hole 43 preferably forms a larger angle with the first bottom surface 45*a* at a meeting point where the tapered surface 43*a* meets the first inclined wall 46*a* than at a non-meeting point where the tapered surface 43*a* does not meet the first inclined wall 46*a*. As indicated in FIG. 4, an expression of $\alpha 1 > \alpha 2$, in which $\alpha 1$ indicates the inclined angle between the tapered surface 43*a* and the first bottom surface 45*a* at the meeting point, and $\alpha 2$ indicates the inclined angle between the tapered surface 43*a* and the first bottom surface 45*a* at the non-meeting point, is satisfied.

The liquid holder 32 may include a protrusion 48, which has the communication hole 44 therein, on the first bottom surface 45*a* of the bottom portion 45 such that the communication hole 44 is open at a position above the bottom portion 45 in the vertical direction.

Next, an operation of the liquid receiving apparatus 15 will be described.

When the liquid ejector 12 has finished printing, the controller 100 opens the air releasing valve 41 and controls the movement mechanism 33 to move the liquid holder 32 at the standby position in the second movement direction −M to the receiving position.

As illustrated in FIG. 4, the liquid holder 32 moves relative to the liquid ejector 12 until the tip end portion of the wall 46 is in contact with the open surface 12*a* of the liquid ejector 12. In this embodiment, the open surface 12*a* is an object to be contacted by the wall 46. In this state, the wall 46 surrounds the ejection holes 23 and makes the liquid retaining section 47 into a closed area CA. This is a capping operation. The capping operation may be done by moving the liquid ejector 12 to the liquid holder 32 positioned at the receiving position, or by moving the liquid holder 32 positioned at the receiving position to the liquid ejector 12. The capping reduces the possibility that the nozzles 17 will dry out, which reduces the chance of defects in ejection caused by clogging of the nozzles 17.

To start printing after the capping operation, the capping should be cancelled by moving the liquid holder 32 away from the liquid ejector 12. In the capping operation, the liquid holder 32 may be in contact with a portion other than the open surface 12*a*. The liquid holder 32 may be in contact with a side surface of the liquid ejector 12, or with a holding member that holds the liquid ejector 12, to define the closed area CA in which the ejection holes 23 are open.

If an ejection defect occurs in the nozzles 17, a maintenance operation is performed to eliminate the defect. In the maintenance operation, the controller 100 drives the reduced-pressure portion 39 after the air releasing valve 41 is opened with the liquid ejector 12 being capped by the liquid holder 32. Thus, the pressure in the closed area CA, in which the ejection holes 23 are open, is reduced through the discharging hole 43, and becomes negative. This eliminates foreign substances such as air bubbles and liquid which may cause an ejection defect. This is referred to as a suction cleaning. The liquid ejected from the nozzles 17 is temporarily retained in the liquid retaining section 47 of the liquid holder 32 and discharged from the liquid retaining section 47 through the discharging hole 43 when the reduced-pressure portion 39 is driven. The discharged liquid flows through the discharging passage 38 to the collection portion 37.

After the suction cleaning, the controller 100 opens the air releasing valve 41 to release the negative pressure in the closed area CA. Then, the capping is cancelled. Additionally, the controller 100 drives the pressure-reduced portion 39 to discharge the liquid in the liquid retaining section 47 through the discharging hole 43. This operation is referred to as an empty suction operation. The empty suction operation can be performed while the closed area CA is capped, as long as the air releasing valve 41 is open.

As described above, the air releasing valve 41 in an open state allows the closed area CA to communicate with the air through the communication hole 44. The reduced-pressure portion 39 may be a tube pump including a rotational member that is configured to rotate while pressing the tube, which is the discharging passage 38. In this configuration, the closed area CA is allowed to communicate with the air when pressing the tube to the rotation member is stopped. Alternatively, the discharging passage 38 may have an air releasing valve. In such a case, the closed area CA can communicate with the air when the air releasing valve is opened. In this case, where the discharging mechanism 34 works as the air ventilation mechanism, the liquid receiving apparatus 15 may not include the air ventilation mechanism 35.

In the liquid ejecting apparatus 11, the liquid ejector 12 may eject liquid droplets onto the liquid holder 32 at the receiving position. This operation is a flushing operation, which is a maintenance operation to eliminate the ejection defect. After the flushing operation, the reduced-pressure portion 39 is driven to discharge the liquid in the liquid retaining section 47 through the discharging hole 43, whereby the empty suction operation is performed.

Next, operations of the liquid ejecting apparatus 11 having the above configuration will be described.

The liquid ejecting apparatus 11 of this embodiment, which performs the printing process sequentially on multiple media S, performs the flushing operation every time printing has been performed on a predetermined number of media, or a predetermined time has passed. If transportation of the medium S is suspended for a flushing operation, printing requires a longer time. Thus, the flushing operation is performed preferably between the transportation of the printed medium S from the printing area PA and the transportation of another medium S to be printed to the printing area PA (between sheets of paper).

In this case, between the transportation of the media S, a series of operations should be performed. Specifically, the support 13 is moved from the supporting position to the retracted position, which is an outward movement, while the liquid holder 32 is moved from the standby position to the receiving position, which is also an outward movement, and the flushing operation is performed. Subsequently, the liquid holder 32 is moved from the receiving position to the standby position, which is a return movement, while the support 13 is moved from the retracted position to the supporting position, which is also a return movement.

As in the above sequential operations, after the first flushing operation performed between the printing operations, printing may be further performed with a predetermined number of media or for a predetermined time. In such a case, the second flushing operation is performed after the support 13 and the liquid holder 32 are moved again. If the transportation speed of the medium S is high, the liquid, which is ejected during the flushing operation and received by the liquid holder 32, cannot be sufficiently discharged as a result of the empty suction operation that is performed while the liquid holder 32 stops at the standby position. Thus, the liquid may be discharged during the movement of the liquid holder 32.

In such a case, the liquid holder 32 is moved from the receiving position in the first movement direction +M with the liquid received at the receiving position being held in the liquid retaining section 47. During this movement, the pressure-reduced portion 39 is driven to discharge the liquid in the liquid retaining section 47 through the discharging hole 43.

When the movement mechanism 33 moves the liquid holder 32 in the first movement direction +M, as indicated by the solid arrow in FIG. 3, the liquid in the liquid retaining section 47 flows in the second movement direction −M, which is opposite to the first movement direction +M, due to the inertial force (a movement operation). Then, the liquid flowing in the second movement direction −M comes in contact with the first inclined wall 46*a*, which oblique to the first movement direction +M, and flows along the first inclined wall 46*a* (a flow operation). Then, the liquid flowing along the first inclined wall 46*a* is discharged through the discharging hole 43 positioned next to the first inclined wall 46*a* (a discharge operation). In this operation, since the discharging hole 43 has the tapered surface 43*a*, the liquid flows smoothly into the discharging hole 43 along the tapered surface 43*a*. Additionally, while the liquid holder 32 is moved in the first movement direction +M, the reduced-pressure portion 39 may be driven to apply suction to the liquid retaining section 47 through the discharging hole 43 (a suction operation). This allows the liquid to be discharged promptly from the liquid retaining section 47 through the discharging hole 43.

The reduced-pressure portion 39 may not be driven when only a small amount of the liquid is held in the liquid retaining section 47, for example. The liquid can be discharged from the liquid retaining section 47 when the liquid flows into the discharging hole 43 along with the movement of the liquid holder 32. In other words, in the discharge operation of discharging the liquid from the liquid retaining section 47 through the discharging hole 43, the suction may not be applied by the driven reduced-pressure portion 39.

If the movement speed of the liquid holder 32 is high, not all liquid in the liquid retaining section 47 can be discharged during the movement of the liquid holder 32 from the receiving position to the standby position. Thus, the reduced-pressure portion 39 may be continuously driven to apply suction to the liquid retaining section 47 while the liquid holder 32 is at the standby position or has been moved from the standby position to the receiving position for the next flushing operation.

Alternatively, a sufficient amount of liquid may not be retained in the liquid retaining section 47 to apply suction after each flushing operation if only a small amount of the liquid is discharged in one flushing operation. In such a case, the reduced-pressure portion 39 may be driven to apply suction to the liquid retaining section 47 when a sufficient amount of the liquid is retained in the liquid retaining section 47 after repeating the flushing operations.

As described above, the liquid holder 32 may be moved in the second movement direction −M, as indicated by an arrow in the two-dotted chain line in FIG. 3, from the standby position to the receiving position with the liquid being held in the liquid retaining section 47. In such a case, the liquid in the liquid retaining section 47 flows in the first movement direction +M, which is opposite to the second movement direction −M, due to the inertial force. Then the liquid flowing in the first movement direction +M comes in contact with the second inclined wall 46*b* and flows along the second inclined wall 46*b*. At this time, although the communication hole 44, which communicates with the ventilation passage 42, is positioned next to the second inclined wall 46*b*, most of the liquid does not enter the communication hole 44 since the communication hole 44 opens at a tip of the protrusion 48 that protrudes from the bottom portion 45 of the liquid retaining section 47.

The above embodiment can provide the following advantages.

(1) When the liquid holder 32 is moved in the first movement direction +M, the liquid in the liquid retaining section 47 flows in the direction opposite to the first movement direction +M on the bottom portion 45 due to the inertial force, and flows along the first inclined wall 46*a* oblique to the first movement direction +M. Then, the liquid flowing along the first inclined wall 46*a* flows to the discharging hole 43, which is positioned next to the first inclined wall 46*a*, to be promptly discharged through the discharging hole 43. Thus, the liquid receiving apparatus 15 has an improved ability to discharge liquid without having an inclined bottom portion 45, which reduces the amount of liquid to be received.

(2) The discharging hole 43 is positioned closer to the edge of the first inclined wall 46*a* on the start position side of the first movement direction +M than to the edge on the end position side of the first movement direction +M. With this configuration, the liquid flowing in the opposite direction along the first inclined wall 46*a* can be gathered from the end position side of the first movement direction +M to the start position side and efficiently discharged through the discharging hole 43.

(3) The tapered surface 43*a* of the discharging hole 43 forms a larger inclined angle with the first bottom surface 45*a* at the meeting point where the tapered surface 43*a* meets the first inclined wall 46*a*. With this configuration, the liquid that comes in contact with the first inclined wall 46*a* is allowed to flow along the tapered surface 43*a* on the part that forms the larger inclined angle, and thus the liquid can be promptly discharged through the discharging hole 43. Additionally, the liquid flowing on the first bottom surface 45*a* toward the discharging hole 43 flows gently along the tapered surface 43*a* on the part that forms the smaller inclined angle. Thus, the liquid can be promptly discharged through the discharging hole 43 without having disturbed liquid flow.

(4) The wall 46 includes two inclined walls 46*a*, 46*b* facing each other. With this configuration, the liquid can flow along any one of the inclined walls 46*a*, 46*b* when the liquid holder 32 is reciprocated in the first movement direction +M. In other words, the liquid can flow along the second inclined wall 46*b*, which is one of the inclined walls 46*a*, 46*b*, during the outward movement of the liquid holder 32, and the liquid can flow along the first inclined wall 46*a*, which is the other one of the inclined walls 46*a*, 46*b*, during the return movement of the liquid holder 32. Furthermore, since the inclined walls 46*a*, 46*b* meet the respective side walls 46*c*, 46*d*, turbulence in the flow in the liquid retaining section 47 can be reduced by allowing the liquid to flow along the inclined walls 46*a*, 46*b* and the side walls 46*c*, 46*d*.

(5) The communication hole 44 is positioned closer than the discharging hole 43 to the edge of the bottom portion 45 on the end position side of the first movement direction +M. With this configuration, most of the liquid flowing along with the movement of the liquid holder 32 does not enter the communication hole 44.

(6) The communication hole 44 opens at a position above the bottom portion 45 in the vertical direction. With this configuration, most of the liquid in the liquid retaining section 47 does not enter the communication hole 44.

(7) The flow of the liquid into the discharging hole 43 is accelerated by applying suction to the liquid retaining section 47 through the discharging hole 43. Thus, the liquid in the liquid retaining section 47 is promptly discharged.

The above embodiment may be modified as per the modifications below. As modifications, the components denoted by the reference signs used in the above embodiment have the same or similar configurations as those of the above embodiment, and the components will not be described. Hereinafter, mainly the features different from those of the above embodiment will be described.

Figure 5:
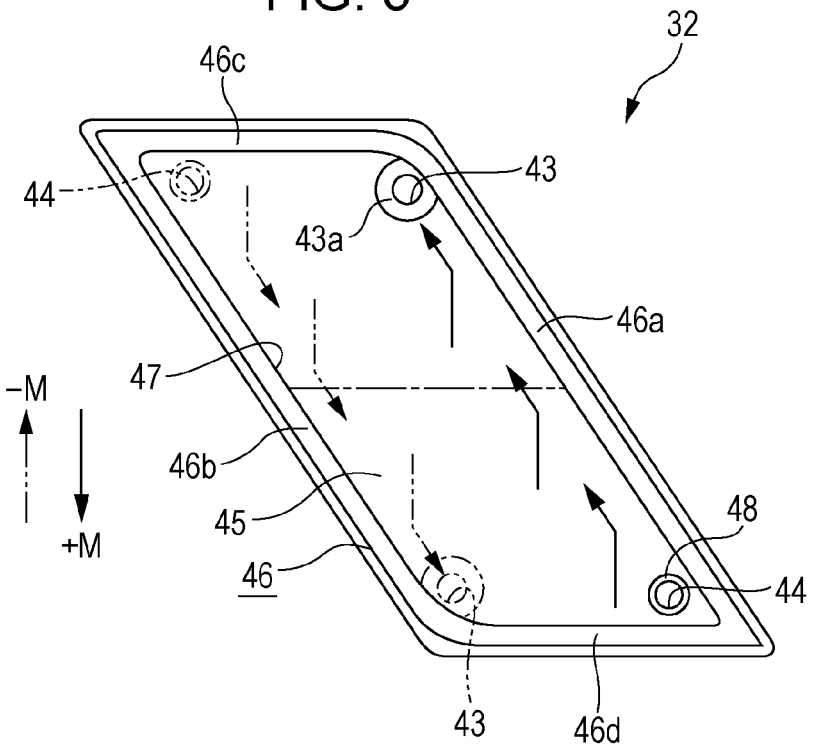
FIG. 5 is a top view illustrating a first modification of a liquid holder.

As per a first modification illustrated in FIG. 5, the inclined walls 46*a*, 46*b* of the liquid holder 32 may curve with respect to the first movement direction +M and meet the side walls 46*c*, 46*d*. This configuration reduces turbulence in the flow and allows the liquid to flow along the first inclined wall 46*a*, when the liquid flowing in the direction opposite to the first movement direction +M comes in contact with the first inclined wall 46*a*, since the first inclined wall 46*a* curves with respect to the first movement direction +M.

Figure 6:
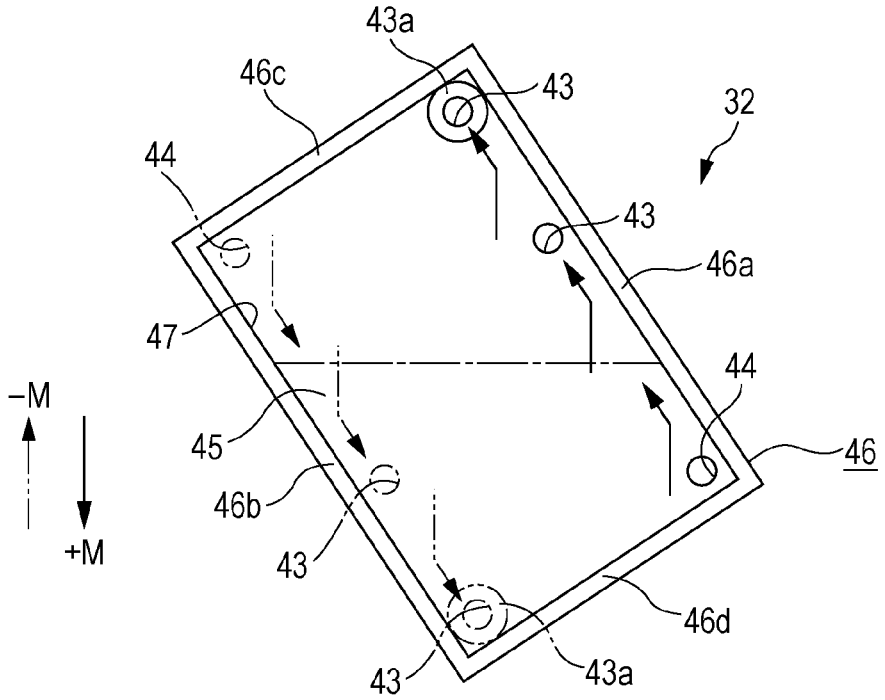
FIG. 6 is a top view illustrating a second modification of the liquid holder.

As illustrated in FIG. 5 and FIG. 6, in addition to the discharging hole 43, through which the liquid is discharged during the movement of the liquid holder 32 in the first movement direction +M, and the communication hole 44, which is disposed in relation to the discharging hole 43, the liquid holder 32 may further include another discharging hole 43, through which the liquid is discharged during the movement in the second movement direction −M, and another communication hole 44, which is disposed in relation to this discharging hole 43. The discharging holes 43 and the communication holes 44 are illustrated by a two-dotted chain line in FIG. 5 and FIG. 6.

As in a first modification illustrated in FIG. 5, the discharging holes 43 and the communication holes 44 may be positioned close to the positions where the inclined walls 46*a*, 46*b* meet the side walls 46*c*, 46*d*. In this configuration, when the liquid holder 32 is moved in the movement direction +M, −M, the liquid flowing from the start position side toward the end position side of the movement directions +M, −M due to the inertial force can be efficiently discharged through the discharging hole 43 positioned closer to an edge on the start position of the movement direction +M, −M. The liquid is less likely to flow to the edge on the end position side of the movement direction +M, −M, in which the communication hole 44 is positioned, and thus most of the liquid does not flow into the communication hole 44.

As in a second modification illustrated in FIG. 6, the wall 46 of the liquid holder 32 may include inclined walls 46*a*, 46*b* and side walls 46*c*, 46*d*, all of which are oblique to the movement direction +M, −M. The liquid holder 32 may have any shape.

As in the second modification in FIG. 6, multiple discharging holes 43 may be disposed in the bottom portion 45 of the liquid holder 32.

As in the second modification in FIG. 6, the liquid holder 32 may include a discharging hole 43 having no tapered surface 43*a*.

Figure 7:
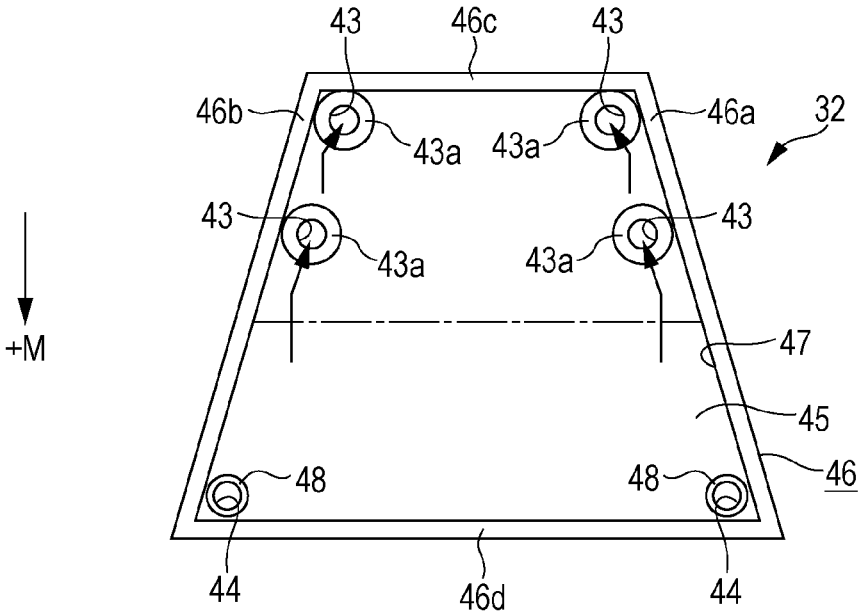
FIG. 7 is a top view illustrating a third modification of the liquid holder.

As the second modification in FIG. 6 and a third modification illustrated in FIG. 7, the tapered surfaces 43*a* of the discharging holes 43 may not meet the inclined walls 46*a*, 46*b*.

As in the second modification in FIG. 6, the liquid holder 32 may not include the protrusion 48, at which the communication hole 44 opens, on the bottom portion 45.

As in the third modification illustrated in FIG. 7, the inclined walls 46*a*, 46*b* of the liquid holder 32 may not be parallel to each other. Particularly, the liquid in the liquid retaining section 47 may be discharged through the discharging hole 43 only when the liquid holder 32 is moved in the first movement direction +M. In such a case, the inclined walls 46*a*, 46*b* are preferably inclined such that edges thereof on the start position side of the first movement direction +M are closer to each other. In addition, multiple discharging holes 43 are preferably disposed next to each of the inclined walls 46*a*, 46*b*. With this configuration, the liquid flowing in the direction opposite to the first movement direction +M is allowed to flow along two inclined walls 46*a*, 46*b* and can be discharged promptly through the discharging holes 43.

The liquid in the liquid retaining section 47 may be discharged through the discharging hole 43 only when the liquid holder 32 is moved in the first movement direction +M. In such a case, the wall facing the first inclined wall 46*a* may not be inclined with respect to the first movement direction +M.

The movement direction of the liquid holder 32 may be any direction intersecting the gravity direction. For example, the liquid holder 32 may be moved in a movement direction along the width direction X, which is a substantially horizontal direction.

The liquid holder 32 may be a flushing box configured to receive the liquid ejected from the liquid ejector 12. In such a case, the liquid holder 32 may not be in contact with the liquid ejector 12, or the liquid receiving apparatus 15 may not include the air ventilation mechanism 35.

The liquid ejected from the liquid ejector 12 may be any liquid other than ink and may be a liquid state material including particles of functional material dispersed or mixed therein. For example, the liquid state material may include a dispersed or dissolved electrode material or color material (pixel material), which are commonly used in the production of a liquid crystal display, an electro luminescence (EL) display, and a surface emitting display. The liquid ejector 12 may eject such a liquid state material for recording (printing).

The medium S is not limited to the sheet, and may be a plastic film, a thin plate, or a fabric used in a textile printing apparatus.

CROSS REFERENCES TO RELATED APPLICATIONS

The entire disclosure of Japanese Patent Application No. 2014-038187, filed on Feb. 28, 2014 is expressly incorporated by reference herein.

What is claimed is:

1. A liquid receiving apparatus comprising:

a liquid holder including: a discharging hole for discharging liquid; a bottom portion in which the discharging hole is disposed; and a wall extending from the bottom portion and surrounding the discharging hole the bottom portion and the wall defining a liquid retaining section configured to retain the liquid, wherein the liquid holder is configured to move in a movement direction intersecting a gravity direction, the wall includes an inclined wall that is oblique to the movement direction, and the discharging hole is positioned next to the inclined wall, wherein the discharging hole is positioned closer to an edge of the inclined wall on a start position side of the movement direction than to another edge of the inclined wall on an end position side of the movement direction.

2. The liquid receiving apparatus according to claim 1, wherein the bottom portion includes a first bottom surface defining the liquid retaining section and a second bottom surface opposite the first bottom surface, the discharging hole has a funnel-like shape having a tapered surface in which an opening area on the second bottom surface of the bottom portion is smaller than an opening area on the first bottom surface, the discharging hole being positioned such that a part of the tapered surface meets the inclined wall, and the tapered surface forms a larger inclined angle with the first bottom surface at the part meeting the inclined wall than at another part thereof not meeting the inclined wall.

3. The liquid receiving apparatus according to claim 1, wherein the wall includes two inclined walls facing each other and two side walls, the inclined walls and the side walls meeting each other.

4. The liquid receiving apparatus according to claim 1, wherein the inclined wall curves with respect to the movement direction.

5. The liquid receiving apparatus according to claim 1, further comprising an air releasing mechanism connected to the liquid holder, wherein the liquid retaining section of the liquid holder is configured to be a closed area when the wall of the liquid holder is in contact with an object, the bottom portion of the liquid holder includes a communication hole communicating with the air releasing mechanism, and the communication hole is positioned closer than the discharging hole to an edge of the bottom portion on an end position side of the movement direction.

6. The liquid receiving apparatus according to claim 5, wherein the communication hole opens at a position above the bottom portion in the vertical direction.

7. A liquid ejecting apparatus comprising:

a liquid ejector configured to eject liquid; and the liquid receiving apparatus according to claim 1.

8. A method of discharging liquid from a liquid retaining section of a liquid holder through a discharging hole, the liquid holder including: the discharging hole for discharging liquid; a bottom portion at which the discharging hole is disposed; and a wall extending from the bottom portion and surrounding the discharging hole, the liquid retaining section being defined by the bottom portion and the wall, the method comprising:

moving the liquid holder in a movement direction intersecting a gravity direction such that the liquid in the liquid retaining section flows in a direction opposite to the movement direction;

allowing the liquid flowing in the direction opposite to the movement direction to flow along an inclined wall that is oblique to the movement direction, the inclined wall being included in the wall; and passing the liquid flowing along the inclined wall through the discharging hole positioned next to the inclined wall to discharge the liquid, wherein the discharging hole is positioned closer to an edge of the inclined wall on a start position side of the movement direction than to another edge of the inclined wall on an end position side of the movement direction.

9. The method of discharging liquid according to claim 8, further comprising applying suction to the liquid retaining section through the discharging hole.

* * * * *